United States Patent [19]

Danner et al.

[11] Patent Number: 4,907,799

[45] Date of Patent: Mar. 13, 1990

[54] EXTENSIBLE-RETRACTABLE POOL AND BILLIARD CUE BRIDGESTICK

[76] Inventors: Michael R. Danner, 4226 2nd Ave. NE., Auburn, Wash. 98105; H. Jack Danner, P.O. Box 1874, Aibirm, Wash. 98071

[21] Appl. No.: 300,604

[22] Filed: Jan. 23, 1989

[51] Int. Cl.[4] ..... A63D 15/10

[52] U.S. Cl. ..... 273/23

[58] Field of Search ..... 273/23

[56] References Cited

FOREIGN PATENT DOCUMENTS 24591 of 1898 United Kingdom ..... 273/23

*Primary Examiner*—T. Brown

*Attorney, Agent, or Firm*—Robert W. Jenny

[57] ABSTRACT

The bridgestick comprises a bridge attached to a stick comprised of telescopic sections and therefore adjustable in length. Length settings are maintained by lock apparatus operated by twisting each section relative to the one it engages or by friction elements. The bridge is rectangular in planform, no higher than the depth of two cue notches and no wider than the depth of one notch plus 102 to 110% of the diameter of the balls being used with the bridgestick. Elastic cord is stretched across each notch near the perimeter of the bridge to limit cue lifting and facilitate lifting and positioning the bridge with the end of the cue.

4 Claims, 1 Drawing Sheet

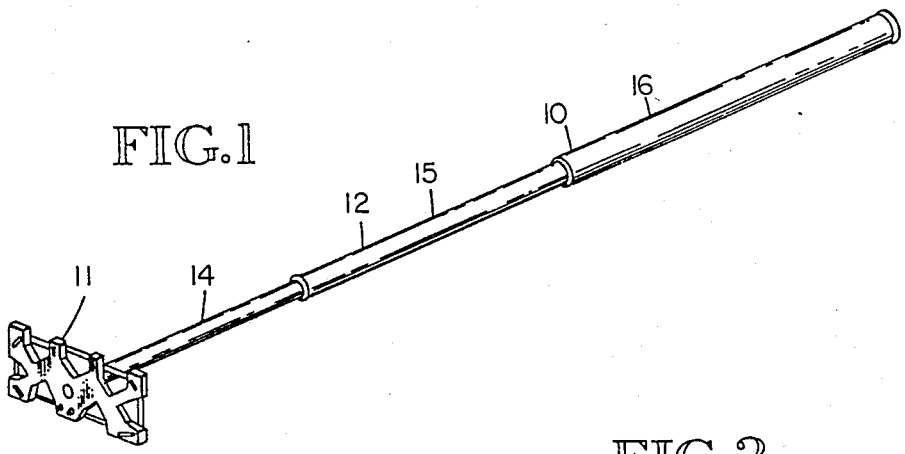
FIG.1
FIG.2
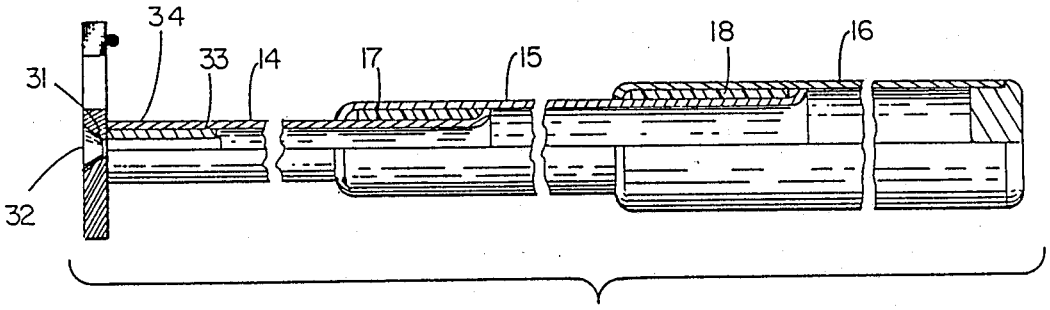
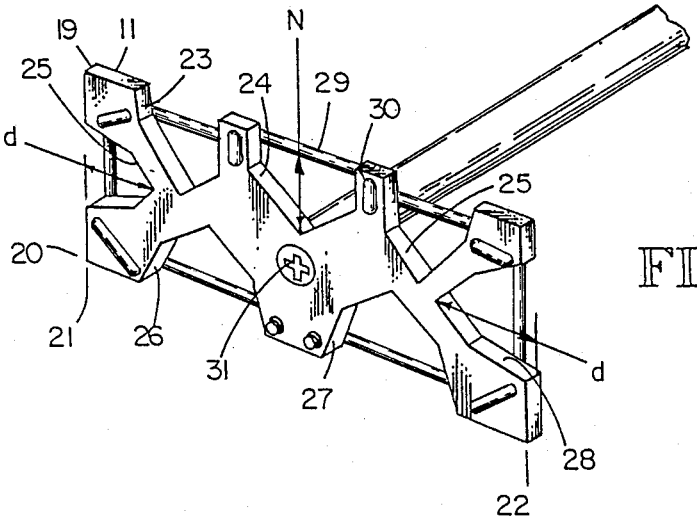
FIG.3

EXTENSIBLE-RETRACTABLE POOL AND BILLIARD CUE BRIDGESTICK

BACKGROUND OF THE INVENTION

Field

The subject invention is in the field of amusement devices, games and apparatus used in such games. Specifically it is in the field of apparatus used in the games of pool and billiards. More specifically it is in the field of apparatus known by a variety of terms, including Cue Bridge, Cue Rest, Pool Bridge, Billiard Bridge, Billiard Cue Bridge and Bridgestick. The term bridgestick is used for the invention and in this patent application.

Prior Art

The prior art includes free standing devices for guiding and supporting pool and billiard cues and similar devices attached to the end of a stick, the stick usually resembling a cue. Although the subject invention is a bridge attached to a stick and is thus a bridgestick, freestanding devices could logically be considered prior art and are included in the following list of known prior art:

| | | | |
|---|---|---|---|
| U.S. Pat. Nos. | | | |
| 196,568 | | 855,684 | |
| 690,617 | | 3,576,324 | |
| | | 3,836,145 | |
| British and U.K: | | | |
| 8,657 | 115,606 | 309,768 | 2,146,908A |
| German: | 343,506 | | |

Experience has shown that the known prior art has certain shortcomings and lacks features which add to the utility of bridgesticks, particularly for the physically handicapped. For example, in some instances the size and shape of the bridge interferes with the visibility of the ball being played in particular and close by balls in general. Also, when using a bridge the cue often strikes the ball at a point above its centerline, tending to cause the cue to lift, thus interfering with the effectiveness of the play. Further, depending on ball position and the physical size and capability of the player, for best play the bridge must be placed at various distances from the player, requiring, for closer positions, holding the stick at some point along its length rather than at its handle, thus introducing a balance problem and making it more difficult to hold the bridge firmly in place or requiring availability of sticks of various lengths.

In view of these facts the overall objective of the subject invention is to provide a bridgestick which overcomes all these shortcomings. One specific objective is to improve visibility of the ball being played and of the nearby balls. A second specific objective is to provide restraint to help prevent lifting of the cue by its contact with the ball. A third specific objective is to provide an adjustable length stick to allow stick length to be set for optimum results. Other objectives will be evident from the following descriptions of the invention.

SUMMARY OF THE INVENTION

The subject bridgestick comprises a bridge attached to one end of a stick, the other end of the stick being termed the handle end. The bridge is made of rigid material approximately ¼ inch thick. It has a rectangular outlie in planform. There are three notches in one of the long sides of the rectangle, two in the other and one notch in each end. The notches in the long sides are essentially evenly spaced between the ends of the bridge and each other. The notch depths and width of the bridge are such that the bottoms of the notches would almost meet if the notches on the long sides were positioned opposite each other. With this condition the height of the bridge is as small as it can be and still have notches of adequate size along both long edges. All the notches are shaped to accept the ends of cues and center the cue in the notch. The length of the rectangle is such that the distance from one end to the bottom of the notch in the other end is slightly greater than the standardized diameter of the balls used in the games of pool and billiards.

The bridge is attached so that its plane is perpendicular to the longitudinal axis of the stick and the end of the stick is positioned at the midpoint of the long dimension of the rectangle and slightly closer to the long edge having two notches than to the edge having three.

An elastic cord is threaded through holes near the edges of the rectangle such that a segment of the cord extends across the open end of each notch. These elastic segments serve two purposes: holding the cue in place in the notch and making it possible to use the cue to help lift and position the bridge. This second purpose is of particular value to handicapped persons.

The stick is made in two or more telescopic sections so that its length can be adjusted. The stick apparatus may allow for locking it at any set length by twisting the segments relative to one another or the set length may be maintained by friction. Telescopic rods and poles of this type are very well known in the art, being used as tent poles, boat hooks, fishing poles, radio antennas, and the like. Using friction to hold the set length is particularly useful to handicapped persons since the stick length can be adjusted using only one arm and hand by engaging the bridge in a pocket of the table, for example and then moving the handle end to set the length.

For purposes of clarity in explaining the invention, the edge with three notches is termed the top, the edge with two notches the bottom and the single notched edges are the ends.

The invention is explained in more detail below with reference to the attached drawings.

BRIEF DESCRIPTION OF THE DRAWINGS

FIG. 1 is a perspective view of the invention.

FIG. 2 is a non-scale schematic sectional view of the bridgestick taken through its longitudinal axis, also showing the attachment of the bridge to the stick.

FIG. 3 is an isometric view of the bridge.

DETAILED DESCRIPTION OF THE INVENTION

FIG. 1 is a perspective view of the subject invention, a bridgestick 10 comprising a bridge 11 and the stick 12 to which it is attached at end 13. The stick comprises three telescopic sections 14, 15 and 16, making its length adjustable. Maintenance of its length at any setting is provided by locking mechanisms actuated by twisting one section relative to a mating section or by means providing frictional restraints of telescopic movement of adjacent sections.

FIG. 2 is a not-to-scale schematic sectional view taken through the longitudinal axis of a bridgestick incorporating friction means to maintain length settings.

Sections 14, 15 and 16 fit together telescopically and elastomeric tubes 17 and 18 are sized diametrically to be compressed when in place and provide the frictional restraint as well as serving as stops to assure adequate overlapping of the sections for structural purposes when each section is fully extended from its mating section.

FIG. 3 is an isometric view of the bridge 11. The bridge is rectangular, having long edges 19 and 20 and short, end edges 21 and 22. Notches 23, 24 and 25 are set into edge 19; notches 26 and 27 are set into edge 20; notch 25 is in end 21 and notch 28 is in end 22. Using two notches in one long edge and three in the other and offsetting their centerlines allows the height of the bridge to be a minimum relative to the slot depths and allowing for adequate structural stiffness of the bridge. Length L of the bridge is determined by the depths d of the slots in the end and the fact that the distance from the bottom of the slot in either end to the other end is slightly greater than the standardized diameters of the balls being used with the bridgestick. The distances from notch bottoms to opposite ends is in the range of 102% to 110% of the ball diameter.

Elastic cord 29 is threaded through holes, hole 30 being typical, located so that the cord stretches across each notch near the perimeter of the bridge and perpendicular to the axis of symmetry of each notch and a distance N from the notch bottoms, distance N in notch 24 being typical. Distance N is somewhat larger than the diameter of the end of a pool or billiard cue, to facilitate inserting the cue into notches but not permit much, if any, motion of the cue out of the slot, depending in part on how far the tapered cue end is moved through the bridge.

The stick is attached to the bridge at hole 3L. The hole is midway between the ends and somewhat closer to edge 20 than to edge 19, centering it generally in the structure between notches 24, 26 and 27.

The attachment of the bridge to the end of the stick is shown in FIG. 2. Screw 32 passes through hole 31 in bridge 11 and threads into plug 33 which is fastened in end 34 of section 14, mechanically or with adhesive as in this embodiment.

To facilitate use of this bridge by an amputee an adaptor may be provided for attaching the handle end of the stick to the wrist, forearm, upper arm or shoulder of the amputee. The adaptor may provide various degrees of control of the bridgestick, depending on a variety of factors but it is noteworthy that the bridgestick is usable with no more control than support of the handle end and capability to push and pull lengthwise of the stick. The connection between the adaptor and stick may incorporate a universal joint, with frictional restraint, without it, or with adjustable friction. The bridgestick can be moved and positioned by support at the handle end and support at the bridge end provided by engagement of the cue tip in a notch under the elastic cord across the notch. Length of the stick is adjusted by engaging the bridge end against a table edge either inside or outside the edge, or in a pocket and pushing or pulling on the handle end to adjust the length.

It is considered to be understandable from this description that the invention meets its objectives. The low height and minimal width, combined with the plurality of notches, provides optimum visibility of the balls in the area in which the bridge is placed. The cord segments across the notches effectively limit lifting of the cue out of the notch and facilitate handling of the bridge with the cue. The length of the stick is readily adjustable, adjustment by amputees being facilitated by use of appropriate adaptors for attaching the handle end of the bridge to the amputee.

It is also believed to be understandable by those skilled in the art that while one embodiment of the invention is described herein, other embodiments and modifications of the one described are possible within the scope of the invention which is limited only by the attached claims.

What is claimed is:

1. A bridgestick for use in a game involving a ball having a standardized diameter, said bridgestick comprising a bridge and a stick, said stick having a first end and a second end, said bridge being attached to said first end and having a perimeter, a plurality of notches set into said perimeter, and elastic means spanning each of said plurality of notches near said perimeter.

2. The bridgestick of claim 1 in which said stick has a length and said length is adjustable.

3. The bridgestick of claim 2 in which said bridge has a height and a width and a first bridge end and a second bridge end and a first notch in said first bridge end and a second notch in said second bridge end, the depth of said first and second notches being a distance d, said width being equal to the sum of said distance d and 102 to 110% of said diameter of said ball.

4. The bridgestock of claim 1 in which said bridge has a height and a width and a first bridge end and a second bridge end and a first notch in said first bridge end and a second notch in said second bridge end, the depth of said first and second notches being a distance d, said width being equal to the sum of said distance d and 102 to 110% of said diameter of said ball.

* * * * *